US008404035B2

(12) United States Patent
Yabe et al.

(10) Patent No.: US 8,404,035 B2
(45) **Date of Patent: *Mar. 26, 2013**

(54) ELECTROLESS COPPER PLATING SOLUTION

(75) Inventors: Atsushi Yabe, Kitaibaraki (JP); Junnosuke Sekiguchi, Kitaibaraki (JP); Toru Imori, Kitaibaraki (JP); Yoshihisa Fujihira, Takatsuki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 900 days.

This patent is subject to a terminal disclaimer.

(21) Appl. No.: 10/576,231

(22) PCT Filed: Jul. 30, 2004

(86) PCT No.: PCT/JP2004/011327

§ 371 (c)(1), (2), (4) Date: Apr. 14, 2006

(87) PCT Pub. No.: WO2005/038086

PCT Pub. Date: Apr. 28, 2005

(65) Prior Publication Data

US 2007/0042125 A1 Feb. 22, 2007

(30) Foreign Application Priority Data

Oct. 17, 2003 (JP) ..... 2003-357992

(51) Int. Cl.
*C23C 18/40* (2006.01)

(52) U.S. Cl. ..... 106/1.26; 427/437; 427/443.1

(58) Field of Classification Search ..... 427/437; 106/1.26

See application file for complete search history.

(56) References Cited

U.S. PATENT DOCUMENTS

| | | | | | |
|---|---|---|---|---|---|
| 3,329,512 | A * | 7/1967 | Shipley, Jr. et al. | ..... | 427/404 |
| 3,993,845 | A * | 11/1976 | Greenberg et al. | ..... | 428/433 |
| 4,655,833 | A * | 4/1987 | Amelio et al. | ..... | 106/1.23 |
| 4,834,796 | A * | 5/1989 | Kondo et al. | ..... | 106/1.23 |
| 2002/0011176 | A1 * | 1/2002 | Yoshida et al. | ..... | 106/1.23 |
| 2004/0152303 | A1 * | 8/2004 | Verbunt | ..... | 438/678 |
| 2007/0071904 | A1 * | 3/2007 | Yabe et al. | ..... | 427/437 |
| 2008/0224313 | A1 * | 9/2008 | Yabe et al. | ..... | 257/741 |

FOREIGN PATENT DOCUMENTS

| | | | |
|---|---|---|---|
| EP | 1109434 | * | 6/2001 |
| JP | 60-245783 | | 12/1985 |
| JP | 03-166383 | * | 7/1991 |
| JP | 3-287779 | | 12/1991 |
| JP | 05-39580 | | 2/1993 |
| JP | 2002-249879 | | 9/2002 |
| WO | WO 01/49898 A1 | | 7/2001 |
| WO | WO 01/63016 A1 | | 8/2001 |
| WO | WO 03/091476 A1 | | 11/2003 |
| WO | WO 2004/108986 A1 | | 12/2004 |

OTHER PUBLICATIONS

Office English Translation of Japan 03-287779, first published in Japanese Dec. 1991.*

* cited by examiner

*Primary Examiner* — Katherine A Bareford

(74) *Attorney, Agent, or Firm* — Flynn, Thiel, Boutell & Tanis, P.C.

(57) ABSTRACT

An electroless copper plating solution that is favorable to improve the adhesion of a plating film and realizes uniform plating at a low temperature is characterized by containing a water-soluble nitrogen-containing polymer in an electroless copper plating solution, and preferably the above-mentioned electroless copper plating solution contains glyoxylic acid and phosphinic acid as reducing agents. The water-soluble nitrogen-containing polymer is preferably a polyacrylamide or a polyethyleneimine and, preferably, its weight average molecular weight (Mw) is at least 100,000 and Mw/Mn is 10.0 or less.

1 Claim, No Drawings

ELECTROLESS COPPER PLATING SOLUTION

TECHNICAL FIELD

This invention relates to an electroless copper plating solution that is used, for example, in the electroless copper plating of a mirror surface such as a semiconductor wafer, and to an electroless copper plating method that makes use of this plating solution.

BACKGROUND ART

Electroless copper plating holds great promise as a method to form a copper film for ULSI fine wiring, and as a replacement for the sputtering and electrolytic copper plating methods currently in use.

Conventionally, when a semiconductor wafer or other such mirror surface was electroless plated with copper, it was difficult to obtain a good adhesion of the deposited plating film. Also, the plating reactivity was low and it was difficult to plate uniformly over the entire substrate. Examples of problems currently encountered in electroless copper plating include a low adhesive strength and poor plating uniformity when a copper film is formed over a barrier metal layer such as tantalum nitride.

Formalin is typically used as a reducing agent for an electroless copper plating solution, but because formalin is harmful to humans and the environment, glyoxylic acid, which shows a similar reaction mechanism, has been studied in recent years as a possible alternative. An electroless copper plating solution in which glyoxylic acid is used as a reducing agent was disclosed in Japanese Patent Publication No. 2002-249879, the object of which was to provide an electroless copper plating solution that could be used stably over an extended period and, in the solution, glyoxylic acid was used as a reducing agent, potassium hydroxide was used as a pH regulator, and methanol, a primary amine, or the like was used as a Cannizzaro's reaction inhibitor.

DISCLOSURE OF THE INVENTION

It is an object of the present invention to provide an electroless copper plating solution that is favorable to improve the adhesion of a plating film, and an electroless copper plating solution which realizes uniform plating at a low temperature.

As a result of diligent study, the inventors discovered that when a water-soluble nitrogen-containing polymer is added as an additive to an electroless copper plating solution, a catalyst metal is made to adhere to the substrate to be plated prior to immersion in the plating solution and the substrate is then immersed in the plating solution so that the polymer is adsorbed over this catalyst metal via nitrogen atoms. As a result, the plating deposition speed is reduced and the crystals become finer, which increases the adhesion of the plating to a wafer or other mirror surface.

They also discovered that when phosphinic acid and glyoxylic acid are used at the same time as reducing agents in an electroless copper plating solution, the initial plating reactivity through the catalyst metal is higher and, as a result, a uniform plating at lower temperatures on a semiconductor or other mirror surface is realized.

Specifically, the present invention is as follows.

(1) An electroless copper plating solution containing a water-soluble nitrogen-containing polymer in the electroless copper plating solution.

(2) An electroless copper plating solution according to (1) above, wherein the water-soluble nitrogen-containing polymer is a polyacrylamide or a polyethyleneimine.

(3) An electroless copper plating solution according to (1) or (2) above, wherein an weight average molecular weight (Mw) of the water-soluble nitrogen-containing polymer is at least 100,000 and Mw/Mn (Mn is a number average molecular weight thereof) is 10.0 or less.

(4) The electroless copper plating solution according to any of (1) to (3) above, wherein the electroless copper plating solution further contains glyoxylic acid and phosphinic acid as reducing agents.

(5) An electroless copper plating method, performed using the electroless copper plating solution according to any of (1) to (4) above.

BEST MODE FOR CARRYING OUT THE INVENTION

Electroless copper plating solutions usually contain copper ions, copper ion complexing agents, reducing agents, pH regulators, and so forth. The electroless copper plating solution of the present invention further contains a water-soluble nitrogen-containing polymer as an additive, the result of which is that the polymer adsorbs via nitrogen atoms over a catalyst metal adhering to a substrate prior to immersion in the plating solution, and this lowers the plating deposition speed and makes the crystals finer, so adhesion is improved in the plating of a wafer or other mirror surface. The effect of the present invention is not brought even when the primary and secondary amines disclosed in the above-mentioned Japanese Patent Publication No. 2002-249879 are used.

The Mw of the water-soluble nitrogen-containing polymer is preferably at least 100,000, and even more preferably at least 1,000,000. At the same time, Mw/Mn is preferably 10.0 or less, and even more preferably 5.0 or less. If Mw is not at least 100,000 and Mw/Mn is not 10.0 or less, the pattern of the plated material will include the polymer of a low molecular weight, this polymer will be admixed into the copper deposited in the pattern, and this will impede the growth of crystal grains and lower the conductivity of the copper.

Examples of the water-soluble nitrogen-containing polymer added as an additive to the electroless copper plating solution include polyacrylamide, polyethyleneimine, polyvinylpyrrolidone, polyvinylpyridine, polyacrylonitrile, polyvinylcarbazole, and polyvinylpyrrolidinone. Of these, polyacrylamide and polyethyleneimine are particularly effective.

The concentration of the water-soluble nitrogen-containing polymer in the plating solution is preferably from 0.0001 to 5 g/L, and even more preferably from 0.0005 to 1 g/L. The above-mentioned effect will not be seen if the concentration is below 0.0001 g/L, and the plating reaction will be overly inhibited and deposition itself will no longer occur if 5 g/L is exceeded.

Taking account of the damage to humans or the environment, it is preferable to use glyoxylic acid, as the reducing agent of the electroless copper plating solution. While phosphinic acid does not exhibit a reductive action on copper, it does exhibit a highly reductive action on palladium and other catalyst metals, so it has the effect of raising the initial plating reactivity via the catalyst metal. Also, no sodium is contained, which is an impurity to be avoided in semiconductor applications.

It is even better to use both glyoxylic acid and phosphinic acid as reducing agents. This combined use provides a higher plating reactivity than when glyoxylic acid is used alone and, as a result, an electroless copper plating solution which realizes uniform plating at lower temperatures on a mirror surface such as a semiconductor wafer, on which a plating reaction is difficult to occur, is obtained. A higher plating reactivity means that plating can be carried out at a lower temperature and lowering the temperature increases the solution stability, tends to result in finer copper particles being deposited and better uniformity.

The concentration of glyoxylic acid in the plating solution is preferably from 0.005 to 0.5 mol/L and, even more preferably, from 0.01 to 0.2 mol/L. No plating reaction will occur if the concentration is less than 0.005 mol/L but the plating solution will become unstable and decompose if 0.5 mol/L is exceeded.

The concentration of phosphinic acid in the plating solution is preferably from 0.001 to 0.5 mol/L and, even more preferably, from 0.005 to 0.2 mol/L. The above-mentioned effect will not be seen if the concentration is below 0.001 mol/L, but the plating solution will become unstable and decompose if 0.5 mol/L is exceeded.

The followings, although not intended to be limiting, are favorable methods to fix a catalyst for electroless copper plating: the method disclosed in International Patent Publication No. WO01/49898A1, in which a pretreatment agent is prepared by reacting or mixing in advance a noble metal compound and a silane coupling agent having a functional group with a metal-capturing capability, and the surface of the article to be plated is treated with this pretreatment agent; the method disclosed in International Patent Application No. PCT/JP03/03707, in which the surface of an article to be plated is coated with a solution of a silane coupling agent having a functional group with a metal-capturing capability, and then coated with an organic solvent solution of a palladium compound; and the method disclosed in International Patent Application No. PCT/JP03/04674, in which the surface of the article to be plated is treated with a silane coupling agent having a functional group with a metal-capturing capability in its molecule, the article is heat treated at a high temperature of at least 200° C., and the article is surface treated with a solution containing a noble metal compound. Using these methods to fix a catalyst further improves the plating uniformity and adhesive strength of the plating.

The adhesive strength, uniformity of the plating and reactivity at a lower temperature can be greatly improved by adding the water-soluble nitrogen-containing polymer as an additive and, in addition, using glyoxylic acid and phosphinic acid at the same time as reducing agents for the plating solution. Because polymers generally have a high molecular weight, they do not readily adhere within a fine wiring pattern, and tend to adhere to surface portions other than the pattern. Accordingly, the deposition of copper tends to be inhibited at the surface portions where the polymer readily adheres and the deposition of copper isn't easily inhibited within the pattern where the polymer is unlikely to adhere. As a result, bottom-up deposition, which is required for pattern embedding, is easy to occur.

Any copper ion source commonly used can be employed as the copper ion source in the electroless copper plating solution of the present invention, examples of which include copper sulfate, copper chloride, and copper nitrate. Any complexing agents commonly used can be utilized as a copper ion complexing agent, so ethylenediaminetetraacetic acid, tartaric acid and so forth are exemplified.

As other additives, any additives commonly used in plating solutions, such as 2,2'-bipyridyl, polyethylene glycol, and potassium ferrocyanide can be used.

The electroless copper plating solution of the present invention is preferably used at a pH of from 10 to 14, and even more preferably a pH of from 12 to 13. Sodium hydroxide, potassium hydroxide, or any other commonly used compounds can be used as a pH regulator.

From the standpoint of bath stability and copper deposition speed, the copper plating solution of the present invention is preferably used at a bath temperature of 55 to 75° C.

When plating is carried out using the electroless copper plating solution of the present invention, the material to be plated is immersed in the plating solution. The material being plated is preferably one that has been pretreated as discussed above, in order to fix a catalyst.

EXAMPLES

A silicon wafer having a trench pattern with an aspect ratio of 2 and a line width of 150 nm, on which a film of tantalum nitride had been formed in a thickness of 15 nm by sputtering, was plated as described in Examples 1 to 5 and Comparative Examples 1 to 4 below, and the adhesive strength of the plating film after the treatment was examined by a tape peel test on the mirror surface portion. In this tape peel test, a pressure sensitive tape (Cellotape®, CT-18 made by Nichiban) was applied to the plating surface, so as not to trap any air, the top of the tape was rubbed with a pencil eraser five times, and then the tape was pulled off all at once and the plating film was observed to check how much had been peeled away. The embedding of the trench portions was checked by SEM observation of the cleavage plane.

A cross-section of the trench portion was also observed by TEM after annealing for 2 hours at 350° C. in an inert gas (argon) atmosphere to check the crystal grain size in the trench portions.

Example 1

The above-mentioned silicon wafer with the tantalum nitride film was immersed for 5 minutes at 50° C. in a plating pretreatment agent for plating prepared by adding a palladium chloride aqueous solution so as to be 50 mg/L to 0.016 wt % aqueous solution of the silane coupling agent that was the equimolar reaction product of imidazolesilane and γ-glycidoxypropyltrimethoxysilane. After this, the wafer was heat treated for 15 minutes at 200° C., and then electroless plated with copper for 30 minutes at 60° C. The composition of the plating solution was copper sulfate 0.02 mol/L, ethylenediaminetetraacetate 0.16 mol/L, glyoxylic acid 0.03 mol/L, phosphinic acid 0.09 mol/L, 2,2'-bipyridyl 10 mg/L, and polyacrylamide (Mw 6,000,000, Mw/Mn=2.4) 50 mg/L, and the pH was 12.5 (pH regulator: potassium hydroxide). The plating film was formed uniformly without unevenness, and the film thickness was 80 nm. The mirror surface portion of the plating film was subjected to the tape peel test after the plating, which revealed a good adhesion, with no peeling at all. Cleavage plane SEM observation revealed that the trench portions had been embedded with no voids. TEM observation for a cross section after annealing revealed the crystal grain size of the trench portions to be at least 100 nm, which was far larger than the about 20 nm size outside the trenches.

Example 2

The above-mentioned silicon wafer with the tantalum nitride film was pretreated by the same method as in Example 1, after which the wafer was electroless plated with copper for 30 minutes at 60° C. The composition of the plating solution was copper sulfate 0.04 mol/L, ethylenediaminetetraacetate 0.4 mol/L, glyoxylic acid 0.1 mol/L, phosphinic acid 0.1 mol/L, 2,2'-bipyridyl 10 mg/L, and polyacrylamide (Mw 6,000,000, Mw/Mn=59.4) 5 mg/L, and the pH was 12.5 (pH regulator: potassium hydroxide). The plating film was formed uniformly without unevenness and the film thickness was 80 nm. The mirror surface portion of the plating film was subjected to the tape peel test after the plating, which revealed a good adhesion, with no peeling at all. Cleavage plane SEM observation revealed that the trench portions had been embedded with no voids. TEM observation for a cross-section after annealing revealed the crystal grain size of the trench portions to be small, at about 20 nm, which was the same as the size outside the trenches.

Example 3

The above-mentioned silicon wafer with the tantalum nitride film was pretreated by the same method as in Example 1, after which the wafer was electroless plated with copper for 60 minutes at 60° C. The composition of the plating solution was copper sulfate 0.04 mol/L, ethylenediaminetetraacetate 0.4 mol/L, glyoxylic acid 0.1 mol/L, phosphinic acid 0.1 mol/L, 2,2'-bipyridyl 10 mg/L, and polyethyleneimine (Mw 1800, Mw/Mn=2.0) 100 mg/L, and the pH was 12.5 (pH regulator: potassium hydroxide). The plating film was formed uniformly without unevenness and the film thickness was 150 nm. The mirror surface portion of the plating film was subjected to the tape peel test after the plating, which revealed a good adhesion, with no peeling at all. Cleavage plane SEM observation revealed that the trench portions had been embedded with no voids. TEM observation for a cross-section after annealing revealed the crystal grain size of the trench portions to be small, at about 20 nm, which was the same as the size outside the trenches.

Example 4

The above-mentioned silicon wafer with the tantalum nitride film was pretreated by the same method as in Example 1, after which the wafer was electroless plated with copper for 30 minutes at 80° C. The composition of the plating solution was copper sulfate 0.04 mol/L, ethylenediaminetetraacetate 0.4 mol/L, glyoxylic acid 0.1 mol/L, 2,2'-bipyridyl 10 mg/L, and polyacrylamide (Mw 6,000,000, Mw/Mn=59.4) 5 mg/L, and the pH was 12.5 (pH regulator: potassium hydroxide). The plating film was deposited in little islands and many portions without deposition were observed. However, when the deposited portions were subjected to a tape peel test, the result showed a good adhesion, with no peeling at all. Cleavage plane SEM observation revealed that the trench portions had been embedded with no voids. TEM observation for a cross-section after annealing revealed the crystal grain size of the trench portions to be small, at about 20 nm, which was the same as the size outside the trenches.

Example 5

The above-mentioned silicon wafer with the tantalum nitride film was pretreated by the same method as in Example 1, after which the wafer was electroless plated with copper for 30 minutes at 80° C. The composition of the plating solution was copper sulfate 0.04 mol/L, ethylenediaminetetraacetate 0.4 mol/L, formalin 0.1 mol/L, 2,2'-bipyridyl 10 mg/L, and polyethyleneimine (Mw 10,000, Mw/Mn=3.1) 50 mg/L, and the pH was 12.5 (pH regulator: potassium hydroxide). The plating film was deposited in little islands and many portions without deposition were observed. However, when the deposited portions were subjected to the tape peel test, the result still showed a good adhesion, with no peeling at all. The trench portion exhibited a better deposition and cleavage plane SEM observation revealed that the trench portions had been embedded with no voids. TEM observation for a cross-section after annealing revealed the crystal grain size of the trench portions to be small, at about 20 nm, which was the same as the size outside the trenches.

Comparative Example 1

The above-mentioned silicon wafer with the tantalum nitride film was pretreated by the same method as in Example 1, after which the wafer was electroless plated with copper for 5 minutes at 60° C. The composition of the plating solution was copper sulfate 0.04 mol/L, ethylenediaminetetraacetate 0.4 mol/L, glyoxylic acid 0.1 mol/L, and phosphinic acid 0.1 mol/L, 2,2'-bipyridyl 10 mg/L, and the pH was 12.5 (pH regulator: potassium hydroxide). The plating film was formed uniformly without unevenness, and the film thickness was 50 nm. However, peeling was noted in some of the plating film. When the mirror surface portion of the plating film was subjected to the tape peel test after the plating, the adhesion was poor, with all of the plating film peeling away. Cleavage plane SEM observation revealed that the film in the trench portions had been formed uniformly, but the portions were not yet fully embedded.

Comparative Example 2

The above-mentioned silicon wafer with the tantalum nitride film was pretreated by the same method as in Example 1, after which the wafer was electroless plated with copper for 5 minutes at 60° C. The composition of the plating solution was copper sulfate 0.04 mol/L, ethylenediaminetetraacetate 0.4 mol/L, glyoxylic acid 0.1 mol/L, and 2,2'-bipyridyl 10 mg/L, and the pH was 12.5 (pH regulator: potassium hydroxide). No plating film was deposited.

Comparative Example 3

The above-mentioned silicon wafer with the tantalum nitride film was pretreated by the same method as in Example 1, after which the wafer was electroless plated with copper for 5 minutes at 80° C. The composition of the plating solution was copper sulfate 0.04 mol/L, ethylenediaminetetraacetate 0.4 mol/L, glyoxylic acid 0.1 mol/L, and 2,2'-bipyridyl 10 mg/L, and the pH was 12.5 (pH regulator: potassium hydroxide). The plating film was deposited in little islands and many portions without deposition were observed. When the deposited portions were subjected to the tape peel test, the adhesion was poor, with all of the plating film peeling away. Cleavage plane SEM observation revealed that the film in the trench portions had been formed uniformly, but the portions were not yet fully embedded.

Comparative Example 4

The above-mentioned silicon wafer with the tantalum nitride film was pretreated by the same method as in Example 1, after which the wafer was electroless plated with copper for 5 minutes at 80° C. The composition of the plating solution was copper sulfate 0.04 mol/L, ethylenediaminetetraacetate 0.4 mol/L, formalin 0.1 mol/L, and 2,2'-bipyridyl 10 mg/L, and the pH was 12.5 (pH regulator: potassium hydroxide). The plating film was deposited in little islands and many portions without deposition were observed. When the deposited portions were subjected to the tape peel test, the adhesion was poor, with all of the plating film peeling away. Cleavage plane SEM observation revealed that the film in the trench portions had been formed uniformly, but the portions were not yet fully embedded.

INDUSTRIAL APPLICABILITY

By the present invention, a water-soluble nitrogen-containing polymer is added as an additive to the electroless copper plating solution, which reduces the plating deposition speed and makes the crystals fine, therefore an electroless copper plating solution which allows better adhesion in plating of a wafer or other mirror surface is obtained. By using glyoxylic acid and phosphinic acid at the same time as reducing agents, the plating reactivity is higher than when glyoxylic acid is used alone and, as a result, an electroless copper plating solution that realizes a uniform plating at lower temperatures on a semiconductor wafer or other mirror surface, on which a plating reaction isn't likely to occur, is obtained.

Furthermore, when a water-soluble nitrogen-containing polymer is added as an additive, it is achieved that copper plating selectively deposits within a pattern by utilizing the difference in how readily this polymer adheres to the portions within and without the pattern of the material to be plated.

In particular, by restricting the Mw of the water-soluble nitrogen-containing polymer added as an additive to be at least 100,000 and also restricting Mw/Mn to be 10.0 or less, there will be substantially no adhesion of this polymer within the pattern of the material to be plated. Thereby, the copper plating is preferentially deposited within the pattern and there is a great reduction in the admixture of the polymer into the copper that is deposited within the pattern, so the crystal grain size is larger and, as a result, there is a further increase in the conductivity of the copper.

The invention claimed is:

1. An electroless copper plating solution consisting of copper sulfate as a copper ion source, polyethyleneimine or polyacrylamide as a water-soluble nitrogen-containing polymer, glyoxylic acid and phosphinic acid as reducing agents, potassium hydroxide as a pH adjuster, ethylenediaminetetraacetate as a complexing agent, solvent and 2,2'-bipyridyl, wherein the concentration of the water-soluble nitrogen-containing polymer is 0.0001-5 g/L, the concentration of glyoxylic acid is 0.005-0.5 mol/L, and the concentration of phosphinic acid is 0.001-0.5 mol/L.

* * * * *